United States Patent [19]

Dickerson

[11] 4,414,304

[45] Nov. 8, 1983

[54] FOREHARDENED HIGH ASPECT RATIO SILVER HALIDE PHOTOGRAPHIC ELEMENTS AND PROCESSES FOR THEIR USE

[75] Inventor: Robert E. Dickerson, Rochester, N.Y.

[73] Assignee: Eastman Kodak Company, Rochester, N.Y.

[21] Appl. No.: 430,574

[22] Filed: Sep. 30, 1982

Related U.S. Application Data

[63] Continuation-in-part of Ser. No. 320,910, Nov. 12, 1981, abandoned.

[51] Int. Cl.[3] ..... G03C 1/02; G03C 1/30; G03C 1/76

[52] U.S. Cl. ..... 430/353; 430/364; 430/434; 430/441; 430/567; 430/568; 430/621; 430/966; 430/502

[58] Field of Search ..... 430/364, 434, 441, 567, 430/621, 966, 353, 568, 502

[56] References Cited

U.S. PATENT DOCUMENTS

| | | | |
|---|---|---|---|
| 3,232,764 | 1/1966 | Allen et al. . | |
| 3,545,971 | 12/1970 | Barnes et al. | 430/966 |
| 3,894,871 | 7/1975 | Land . | |
| 4,063,951 | 12/1977 | Bogg . | |
| 4,067,739 | 1/1978 | Lewis . | |
| 4,150,994 | 4/1979 | Maternaghan . | |
| 4,172,730 | 10/1979 | Hinata et al. | 430/966 |
| 4,184,877 | 1/1980 | Maternaghan . | |
| 4,184,878 | 1/1980 | Maternaghan . | |

FOREIGN PATENT DOCUMENTS

| | | |
|---|---|---|
| 2905655 | 2/1979 | Fed. Rep. of Germany . |
| 2921077 | 5/1979 | Fed. Rep. of Germany . |
| 55-142329 | 11/1980 | Japan . |
| 1570581 | 5/1977 | United Kingdom . |

OTHER PUBLICATIONS

James, *Theory of the Photographic Process,* 4th Ed., Macmillan, 1977, pp. 404, 489 and 490.

Farnell and Solman, "The Covering Power of Photographic Silver Deposits I. Chemical Development", *The Journal of Photographic Science,* vol. 18, 1970 pp. 94–101.

Zelikman and Levi *Making and Coating Photographic Emulsions* Focal Press 1964, p. 223.

deCugnac and Chateau, "Evolution of the Morphology of Silver Bromide Crystals During Physical Ripening", *Science et Industries Photographiques,* vol. 33, No. 2 (1962), pp. 121–125.

Duffin, *Photographic Emulsion Chemistry,* Focal Press, 1966, pp. 66–72.

Trivelli and Smith, "The Effect of Silver Iodide Upon the Structure of Bromo-Iodide Precipitation Series", *The Photographic Journal,* vol. LXXX, Jul. 1940, pp. 285–288.

Gutoff, "Nucleation and Growth Rates During the Precipitation of Silver Halide Photographic Emulsions", *Photographic Sciences and Engineering,* vol. 14, No. 4, Jul.-Aug. 1970, pp. 248–257.

*Primary Examiner*—Richard L. Schilling
*Attorney, Agent, or Firm*—Carl O. Thomas

[57] ABSTRACT

Forehardened photographic elements, particularly radiographic elements, intended to produce silver images are disclosed including among hydrophilic colloid layers at least one emulsion layer containing thin tabular silver halide grains. When developed in less than 1 minute to produce a viewable silver image, these photographic elements exhibit increased covering power.

24 Claims, No Drawings

FOREHARDENED HIGH ASPECT RATIO SILVER HALIDE PHOTOGRAPHIC ELEMENTS AND PROCESSES FOR THEIR USE

This is a continuation-in-part of copending, commonly assigned U.S. Ser. No. 320,910, filed Nov. 12, 1981, now abandoned.

FIELD OF THE INVENTION

This invention relates to silver halide photography. More specifically, this invention relates to forehardened silver halide photographic elements, particularly radiographic elements, and to processes for their use.

BACKGROUND OF THE INVENTION

Black-and-white silver halide photography has relied traditionally upon developed silver to produce a viewable image. Although black-and-white photography serves a variety of imaging needs, medical radiography, described below, illustrates the varied and in some instances competing demands that are encountered in silver imaging.

In medical radiography comparatively large areas of the radiation-sensitive material are often required for a single exposure—i.e., large format exposures are common. Further, the silver which remains in the element for imaging may be unavailable for reclamation for many years. Therefore, it is highly desirable to make efficient use of the silver which the radiographic elements contain. One measure of the efficiency of silver use is covering power. Covering power is herein defined as 100 times the ratio of maximum density to developed silver, expressed in grams per square decimeter. High covering power is recognized to be an advantageous characteristic of not only radiographic elements, but other black-and-white photographic elements as well. Covering power and conditions which affect it are discussed by James, *Theory of the Photographic Process,* 4th Ed., Macmillan, 1977, pp. 404, 489, and 490, and by Farnell and Solman, "The Covering Power of Photographic Silver Deposits I. Chemical Development", *The Journal of Photographic Science,* Vol. 18, 1970, pp. 94–101.

One approach to achieving high covering power is to employ relatively fine silver halide grains, since it is well recognized that increasing grain size will reduce covering power. Unfortunately, in medical radiography even more important than achieving efficient use of silver is the need to minimize patient exposure to X-radiation. Since silver halide becomes more sensitive (increases in speed) as a direct function of grain size, it is not then surprising that radiographic elements commonly employ large grain sizes. Thus, although attaining high covering power is important, the comparatively coarse silver halide emulsions actually employed are not well suited to achieving high levels of covering power.

Other techniques are therefore employed to improve covering power. It is known that larger silver halide grain sizes, typically at least about 0.6 micron in average diameter and larger, are subject to reductions in covering power as a function of hardening. To achieve the highest covering power compatible with speed requirements (and therefore grain size requirements), it is common practice in the art to limit forehardening (i.e., hardening during manufacture) to just the degree necessary to permit the radiographic elements to be handled (although the risk of damage of such materials remains comparatively high).

Final hardening to the desired level is achieved by incorporating a hardener in the processing composition, usually the developer. Particularly effective hardeners for use in processing compositions are dialdehydes and bis-bisulfite derivatives thereof of the type disclosed in Allen and Burness U.S. Pat. No. 3,232,764. Unfortunately, the hardener must be kept separate from the developer composition prior to use. Further, the presence of such hardener places additional constraints on the choice of developer compositions.

In a typical medical radiographic application a radiographic film is employed having relatively coarse silver halide emulsions coated on both major surfaces. The emulsion layers are minimally forehardened to achieve maximum covering power. The element is more sensitive to light than to X-radiation and is therefore typically placed between a pair of fluorescent screens which, upon imagewise exposure to X-radiation, imagewise fluoresce to expose the radiographic element. Thereafter the radiographic element is processed in a developer containing a hardener. To provide rapid access to a viewable image, the radiographic element is processed at temperatures above ambient (typically about 25° to 50° C.) and in time periods of less than 1 minute. Development is usually complete in about 20 seconds. A typical process of the type described above is illustrated by Barnes et al U.S. Pat. No. 3,545,971.

A great variety of regular and irregular grain shapes have been observed in silver halide photographic emulsions intended for black-and-white imaging applications generally and radiographic imaging applications specifically. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. Nos. 3,894,871 and Zelikman and Levi *Making and Coating Photographic Emulsions,* Focal Press, 1964, page 223. Rods and tabular grains in varied portions have been frequently observed mixed in among other grain shapes, particularly where the pAg (the negative logarithm of silver ion concentration) of the emulsions has varied during precipitation, as occurs, for example in single-jet precipitations.

Tabular silver bromide grains have been extensively studied, often in macro-sizes having no photographic utility. Tabular grains are herein defined as those having two substantially parallel crystal faces, each of which is substantially larger than any other single crystal face of the grain. The aspect ratio—that is, the ratio of diameter to thickness—of tabulator grains is substantially greater than 1:1. High aspect ratio tabular grain silver bromide emulsions were reported by de Cugnac and Chateau, "Evolution of the Morphology of Silver Bromide Crystals During Physical Ripening", *Science et Industries Photographiques,* Vol. 33, No. 2 (1962), pp. 121–125.

From 1937 until the 1950's the Eastman Kodak Company sold a Duplitized® fully forehardened radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the range of from about 5 to 7:1. The tabular grains accounted for greater than 50% of the projected area while nontabular grains accounted for greater than 25% of the projected area. The emulsion having the thinnest average grain thickness, chosen from several remakes, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Although tabular grain silver bromoiodide emulsions are known in the art, none exhibit a high average aspect ratio. A discussion of tabular silver bromoiodide grains appears in Duffin, *Photographic Emulsion Chemistry,* Focal Press, 1966, pp. 66–72, and Trivelli and Smith, "The Effect of Silver Iodide Upon the Structure of Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Gutoff, "Nucleation and Growth Rates During the Precipitation of Silver Halide Photographic Emulsions", *Photographic Sciences and Engineering,* Vol. 14, No. 4, July-August 1970, pp. 248–257, reports preparing silver bromide and silver bromoiodide emulsions of the type prepared by single-jet precipitations using a continuous precipitation apparatus.

Bogg, Lewis, and Maternaghan have recently published procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. In the example reported the average edge length of the grains was 0.93 micron and the average aspect ratio 2:1. Thus the average grain thickness was 0.46 micron, indicating thick tabular grains were produced. Lewis U.S. Pat. No. 4,067,739 teaches the preparation of silver halide emulsions wherein most of the crystals are of the twinned octahedral type by forming seed crystals, causing the seed crystals to increase in size by Ostwald ripening in the presence of a silver halide solvent, and completing grain growth without renucleation or Ostwald ripening while controlling pBr (the negative logarithm of bromide ion concentration). Maternaghan U.S. Pat. Nos. 4,150,994, 4,184,877, and 4,184,878, U.K. Pat. No. 1,570,581, and German OLS publications 2,905,655 and 2,921,077 teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed.) Lewis and Maternaghan report increased covering power. Maternaghan states that the emulsions are useful in camera films, both black-and-white and color. It appears from repeating examples and viewing the photomicrographs published that average tabular grain thicknesses were greater than 0.40 micron. Japanese patent Kokai 142,329, published Nov. 6, 1980, appears to be essentially cumulative with Maternaghan, but is not restricted to the use of silver iodide seed grains. Thus, the patents discussed above in this paragraph are viewed as teaching the preparation of silver halide emulsions containing relatively thick tabular grains of intermediate average aspect ratios.

Wilgus and Haefner U.S. Ser. No. 429,420, filed concurrently herewith and commonly assigned, titled HIGH ASPECT RATIO SILVER BROMOIODIDE EMULSIONS AND PROCESSES FOR THEIR PREPARATION, which is a continuation-in-part of U.S. Ser. No. 320,905, filed Nov. 12, 1981, now abandoned, more fully discussed below, discloses high aspect ratio silver bromoiodide emulsions and a process for their preparation.

Kofron et al U.S. Ser. No. 429,407, filed concurrently herewith and commonly assigned, titled SENSITIZED HIGH ASPECT RATIO SILVER HALIDE EMULSIONS AND PHOTOGRAPHIC ELEMENTS, which is a continuation-in-part of U.S. Ser. No. 320,904, filed Nov. 12, 1981, now abandoned, more fully discussed below, discloses chemically and spectrally sensitized high aspect ratio tabular grain silver halide emulsions and photographic elements incorporating these emulsions.

Daubendiek and Strong U.S. Ser. No. 429,587, filed concurrently herewith and commonly assigned, titled AN IMPROVED PROCESS FOR THE PREPARATION OF HIGH ASPECT RATIO SILVER BROMOIODIDE EMULSIONS, which is a continuation-in-part of U.S. Ser. No. 320,906, filed Nov. 12, 1981, now abandoned, more fully discussed below, discloses an improvement on the processes of Maternaghan whereby high aspect ratio tabular grain silver bromoiodide emulsions can be prepared.

Abbott and Jones U.S. Ser. No. 430,222, filed concurrently herewith and commonly assigned, titled RADIOGRAPHIC ELEMENTS EXHIBITING REDUCED CROSSOVER, which is a continuation-in-part of U.S. Ser. No. 320,907, filed Nov. 12, 1981, more fully discussed below, discloses the use of high aspect ratio tabular grain silver halide emulsions in radiographic elements coated on both major surfaces of a radiation transmitting support to control crossover.

Abbott and Jones U.S. Ser. No. 431,910, filed concurrently herewith and commonly assigned, titled RADIOGRAPHIC ELEMENTS EXHIBITING REDUCED CROSSOVER, more fully discussed below, discloses the use of thin, intermediate aspect ratio tabular grain silver halide emulsions in radiographic elements coated on both major suirfaces of a radiation transmitting support to control crossover.

Wey U.S. Ser. No. 429,403, filed concurrently herewith and commonly assigned, titled IMPROVED DOUBLE-JET PRECIPITATION PROCESS AND PRODUCTS THEREOF, which is a continuation-in-part of U.S. Ser. No. 320,908, filed Nov. 12, 1981, now abandoned, more fully discussed below, discloses a process of preparing tabular silver chloride grains which are substantially internally free of both silver bromide and silver iodide. The emulsions have an average aspect ratio of greater than 8:1.

Solberg, Piggin, and Wilgus U.S. Ser. No. 431,913, filed concurrently herewith and commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1981, now abandoned, more fully discussed below, discloses high aspect ratio tabular grain silver bromiodide emulsions wherein a higher concentration of iodide is present in an annular region than in a central region of the tabular grains.

Mignot U.S. Ser. No. 320,912, filed Nov. 12, 1981 and commonly assigned, titled SILVER BROMIDE EMULSIONS OR NARROW GRAIN SIZE DISTRIBUTION AND PROCESSES FOR THEIR PREPARATION discloses high aspect ratio tabular grain silver bromide emulsions wherein the tabular grains are square or rectangular in projected area.

Maskasky U.S. Ser. No. 431,455, filed concurrently herewith and commonly assigned, titled SILVER CHLORIDE EMULSIONS OF MODIFIED CRYSTAL HABIT AND PROCESSES FOR THEIR PREPARATION, which is a continuation-in-part of U.S. Ser. No. 320,898, now abandoned, filed Nov. 12, 1981, discloses a process of preparing tabular grains having opposed major crystal faces lying in {111} crystal planes and, in one preferred form, at least one peripheral edge lying perpendicular to a <211> crystallographic vector in the plane of one of the major surfaces. Thus, the crystal edges obtained are crystallographically offset 30° C. as compared to those of Wey. Maskasky requires that the novel tabular grains be predominantly (that is, at least 50 mole percent) chloride.

Wey and Wilgus U.S. Ser. No. 431,854, filed concurrently herewith and commonly assigned, titled NOVEL SILVER CHLOROBROMIDE EMULSIONS AND PROCESSES FOR THEIR PREPARATION which is a continuation-in-part of U.S. Ser. No. 320,899, filed Nov. 12, 1981, now abandoned, discloses tabular grain silver chlorobromide emulsions in which the molar ratio of chloride to bromide ranges up to 2:2.

Maskasky U.S. Ser. No. 431,855, filed concurrently herewith and commonly assigned, titled CONTROLLED SITE EPITAXIAL SENSITIZATION, which is a continuation-in-part of U.S. Ser. No. 320,920, now abandoned, filed Nov. 12, 1981, discloses high aspect ratio tabular grain emulsions wherein silver salt is epitaxially located on and substantially confined to selected surface sites of the tabular silver halide grains.

SUMMARY OF THE INVENTION

In one aspect this invention is directed to a photographic element comprised of a support and, located on the support, one or more hydrophilic colloid layers including at least one emulsion layer containing radiation-sensitive silver halide grains. The photographic element is characterized by at least 50 percent of the total projected area of said silver halide grains in at least one emulsion layer being provided by thin tabular grains having a thickness of less than 0.3 micron. Further, the hydrophilic colloid layers are forehardened in an amount sufficient to reduce swelling of the layers to less than 200 percent. Percent swelling is determined by (a) incubating the photographic element at 38° C. for 3 days at 50 percent relative humidity, (b) measuring layer thickness, (c) immersing the photographic element in distilled water at 21° C. for 3 minutes, and (d) determining change in layer thickness as compared to the layer thickness measured in step (b).

In one preferred form the photographic element is a radiographic element comprised of a substantially specularly transmissive support having first and second major surfaces each coated with one or more hydrophilic colloid layers including at least one emulsion layer containing radiation-sensitive silver halide grains. The radiographic element is characterized by silver halide grain and hydrophilic colloid layer features specifically set forth above.

In another aspect this invention is directed to a process of producing a high covering power silver image comprising imagewise exposing a photographic element or, specifically, a radiographic element, as described above, and developing a viewable image in less than 1 minute.

The present invention allows a black-and-white photographic element intended to form a viewable silver image to be sufficiently forehardened that no additional hardening is required in processing and still achieve high levels of covering power. The invention satisfies a long-standing need in the art for relatively high speed, high covering power photographic elements, particularly radiographic elements, that can be rapidly processed without encountering the risk of damage due to incomplete hardening or requiring the use of a processing bath containing a hardener.

As taught by Abbott and Jones, cited above, the radiographic elements of this invention exhibit significantly reduced crossover and therefore less reduction in sharpness attributable to crossover, taking other photographic characteristics into account. More specifically, the radiographic elements of this invention have at least one silver halide emulsion layer which, at a selected silver coverage (based on the weight of silver per unit area of the emulsion layer) and a comparable photographic speed, permit less crossover of exposing radiation.

DESCRIPTION OF PREFERRED EMBODIMENTS

The present invention is generally applicable to black-and-white photographic elements intended for use in forming viewable retained silver images having at least one relatively coarse grain silver halide emulsion layer containing a hardenable hydrophilic colloid or its equivalent. To achieve the advantages of this invention thin tabular grain silver halide emulsions are employed to form at least one of the emulsion layers.

As applied to the silver halide emulsions the term "thin" is herein defined as requiring that the tabular silver halide grains have a thickness of less than 0.3 micron. In a specifically preferred form the thin tabular grain silver halide emulsions have an average grain thickness of less than 0.2 micron. The covering power advantages of this invention bear an inverse relationship to the average thickness of the tabular grains of the thin tabular grain silver halide emulsions employed. Typically the tabular grains have an average thickness of at least 0.03 micron, although even thinner tabular grains can in principle be employed—e.g., as low as 0.01 micron, depending upon halide content.

Although thin tabular grain emulsions can achieve advantages in covering power at low aspect ratios, in order to achieve other tabular grain silver halide advantages, such as those taught by Kofron et al and Abbott and Jones, cited above, in combination with covering power advantages, it is preferred that the thin tabular grain silver halide emulsions employed in the practice of this invention have an average aspect ratio of at least 5:1. The preferred thin tabular grain silver halide emulsions are high aspect ratio thin tabular grain emulsions. High aspect ratio thin tabular grain emulsions are those in which the thin tabular grains have an average aspect ratio of greater than 8:1 and account for at least 50 percent of the total projected area of the silver halide grains. In a preferred form of the invention these thin tabular silver halide grains account for at least 70 percent and optimally at least 90 percent of the total projected area of the silver halide grains.

Increases in covering power are particularly in evidence when the tabular silver halide grains having a thickness of less than 0.3 micron have an average diameter of at least 0.6 microns, optimally an average diameter of at least 1 micron.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each grain and to identify those tabular grains having a thickness of less than 0.3 micron—i.e., thin tabular grains. From this the aspect ratio of each such thin tabular grain can be calculated, and the aspect ratios of all the thin tabular grains in the same (meeting the less than 0.3 micron thickness) can be averaged to obtain their average aspect ratio. By this definition the average aspect ratio is the average of individual thin tabular grain aspect ratios. In practice it is usually simpler to obtain an average thickness and an average diameter of the thin tabular grains and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the thin tabular silver halide grains can be summed, the projected areas of the remaining silver halide grains in the photomicrograph can be summed separately, and from the two sums the percentage of the total projected area of the thin tabular silver halide grains can be calculated.

In the above determinations a reference tabular grain thickness of less than 0.3 micron was chosen to distinguish the uniquely thin tabular grains herein contemplated from thicker tabular grains which provide inferior photographic properties. At lower diameters it is not always possible to distinguish tabular and nontabular grains in micrographs. Thin tabular grains for purposes of this disclosure are those silver halide grains which are less than 0.3 micron in thickness and appear tabular at 2,500 times magnification. The term "projected area" is used in the same sense as the terms "projection area" and "projective area" commonly employed in the art; see, for example, James and Higgins, *Fundamentals of Photographic Theory*, Morgan and Morgan, New York, p. 15.

Although only one thin tabular grain emulsion layer is required in the photographic elements of this invention, the photographic elements can, if desired, contain a plurality of such tabular grain emulsion layers. Emulsions other than the required thin tabular grain emulsion can take any convenient form. Various conventional emulsions are illustrated by *Research Disclosure*, Vol. 176, December 1978, Item 17643, Paragraph I, Emulsion preparation and types, here incorporated by reference. (*Research Disclosure* and *Product Licensing Index* are publications of Industrial Opportunities Ltd.; Homewell, Havant; Hampshire, P09 1EF, United Kingdom). It is additionally contemplated to employ thin tabular grain emulsion layers in combination with thicker high aspect ratio tubular grain emulsion layers, such as those having average tabular grain thicknesses up to 0.5 micron described by Kofron et al, cited above.

The silver halide emulsion layers and other layers, if any, such as overcoat layers, interlayers, and subbing layers, of the photographic elements can contain various hardenable colloids alone or in combination as vehicles. As employed herein the term vehicle is inclusive of both binders and peptizers. The photographic elements of this invention are forehardened. That is, the colloids are sufficiently cross-linked that no subsequent hardening is required after manufacture. The hydrophilic colloid containing layers are sufficiently forehardened to reduce swelling thereof to less than 200 percent. Although a number of similar swell tests have been employed, for purposes of providing a specific definition, percent swell is herein defined as the percentage determined by the procedure of Example 11 of Burness et al U.S. Pat. No. 3,841,872, but with an incubation temperature of 38° C. and an immersion temperature of 21° C. Specifically, percent swell is determined by (a) incubating the photographic element at 38° C. for 3 days at 50 percent relative humidity, (b) measuring layer thickness, (c) immersing the photographic element in distilled water at 21° C. for 3 minutes, and (d) determining the percent change in layer thickness as compared to the layer thickness measured in step (b). The percentage of swell is the product of the difference between the final layer thickness and the original (post-incubation) layer thickness divided by original layer thickness and multiplied by 100. It is preferred that the photographic elements of this invention exhibit less than 100 percent swell. As is well understood in the art, the percentage of swell can be controlled by adjusting the concentration of the hardener employed.

It has been surprisingly observed that forehardening of photographic elements according to the present invention does not produce the reduction in covering power observed in forehardened commercial photographic elements lacking thin tabular grain silver halide emulsions, as described above, particularly those containing silver halide grains having an average diameter based on projected area of at least 0.6 micron. Further, the forehardened photographic elements of this invention have a higher covering power than comparable forehardened photographic elements containing nontabular silver halide grains of the same average diameter, based on projected area. Further, the photographic elements according to the present invention also exhibit a higher covering power than otherwise comparable photographic elements employing tabular silver halide grains of greater average tabular grain thickness, whether of the same average diameter or higher average aspect ratio. Although high covering power has heretofore been attained in the art by employing smaller average silver halide grains, such grain sizes have restricted photographic speed. The present invention provides for the first time the opportunity to provide higher speed forehardened photographic elements without incurring a substantial reduction in covering power.

Since the photographic elements of this invention can contain other, conventional emulsion layers in addition to the required thin tabular grain silver halide emulsions, the overall covering power for the photographic element (as opposed to individual emulsion layers) can vary widely. However, in preferred photographic elements according to the invention, particularly those in which all of the emulsion layers present contain thin tabular grains having a thickness of less than 0.2 micron, the photographic elements exhibit a covering power of at least 80, preferably at least 100, and optimally at least 110 when developed in less than 1 minute, particularly at higher than ambient temperatures (e.g., 25° to 50° C.).

The thin tabular grain silver halide emulsion layers and other layers of the photographic elements can contain various hardenable colloids alone or in combination as vehicles. Suitable hydrophilic colloids include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. No. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Hori et al Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517. Gelatin and gelatin derivatives are preferred vehicles.

The emulsion layers and other layers of the photographic elements, such as overcoat layers, interlayers and subbing layers can also contain alone or in combination with hydrophilic water permeable colloids as vehicles or vehicle extenders (e.g., in the form of latices), synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055.

The layers of the photographic element containing crosslinkable colloids—e.g., the gelatin or gelatin derivative containing layers—can be forehardened by various organic and inorganic hardeners, such as those described in T. H. James, *The Theory of the Photographic Process,* 4th Ed., MacMillan, 1977, pp. 77–87. The forehardeners can be used alone or in combination and in free or in blocked form.

Typical useful forehardeners include formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active vinyl groups (e.g. vinylsulfonyl groups), as illustrated by Burness et al U.S. Pat. Nos. 3,490,911, 3,539,644 and 3,841,872 (Reissue 29,305), Cohen U.S. Pat. No.

3,640,720, Kleist et al German Pat. No. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelman et al U.S. Pat. No. 3,396,029.

The use of forehardeners in combination is illustrated by Sieg et al U.S. Pat. No. 3,497,358, Dallon et al U.S. Pat. Nos. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708. The patents illustrative of hardeners and hardener combinations are here incorporated by reference.

The tabular grains can be of any silver halide crystal composition known to be useful in photography. In a preferred form offering a broad range of observed advantages the present invention employs thin tabular grain silver bromoiodide emulsions. High aspect ratio silver bromoiodide emulsions and their preparation is the subject of Wilgus and Haefner, cited above and here incorporated by reference. Generally similar procedures can be used to form thin, high aspect ratio tabular grain silver bromoiodide emulsions for use in the radiographic elements of this invention. Intermediate, as opposed to high, aspect ratios can be achieved merely by terminating precipitation earlier. Obtaining thin grains at the outset of precipitation, as described below, will result in the tabular grain emulsions having thin tabular grains.

Thin tabular grain silver bromoiodide emulsions can be prepared by a precipitation process similar to that which forms a part of the Wilgus and Haefner invention as follows: Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bomoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. As employed herein, the term "substantially free of iodide ions" as applied to the contents of the reaction vessel means that there are insufficient iodide ion present as compared to bromide ions to precipitate as a separate silver iodide phase. It is preferred to maintain the iodide concentration in the reaction vessel prior to silver salt introduction at less than 0.5 mole percent of the total halide ion concentration present.

If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontabular silver bromoiodide grains is favored. Therefore, it is contemplated to maintain the pBr of the reaction vessel at or above 0.6, preferably above 1.1. (As herein employed, pBr is defined as the negative logarithm of bromide ion concentration. Both pH and pAg are similarly defined for hydrogen and silver ion concentrations, respectively.)

During precipitation silver, bromide, and iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts are added to the reaction vessel separately or as a mixture.

With the introduction of silver salt into the reaction vessel the nucleation stage of grain formation is initiated. A population of grain nuclei are formed which are capable of serving as precipitation sites for silver bromide and silver iodide as the introduction of silver, bromide, and iodide salts continues. The precipitation of silver bromide and silver iodide onto existing grain nuclei constitutes the growth stage of grain formation.

The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.5. it is, of course, possible and, in fact, preferred to maintain the pBr within the reaction vessel throughout silver and halide salt introduction within the initial limits, described above prior to silver salt introduction. This is particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing thin tabular silver bromoiodide grains.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide are precipitated in preference to chloride, it is also possible to employ silver chlorobromide and silver chlorobromoiodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 0.5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentration of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European Patent Application No. 80102242, and Wey "Growth Mechanism of AgBr Crystals in Gelatin Solution", *Photographic Science and Engineering*, Vol. 21, No. 1, January/February 1977, p. 14, et. seq. By avoiding the formation of additional grain nuclei after passing into the growth stage of precipitation, relatively monodispersed thin tabular silver bromoiodide grain populations can be obtained. Emulsions having coefficients of variation of less than about 30 percent can be prepared. (As employed herein the coefficient of variation is defined as 100 times the standard deviation of the grain diameter divided by the average grain diameter). By intentionally favoring renucleation during the growth stage of precipitation, it is, of course, possible to produce polydispersed emulsions of substantially higher coefficients of variation.

The concentration of iodide in the silver bromoiodide emulsions of this invention can be controlled by the introduction of iodide salts. Any conventional iodide concentration can be employed. Even very small amounts of iodide—e.g., as low as 0.05 mole percent—are recognized in the art to be beneficial. (Except as otherwise indicated, all references to halide percentages are based on silver present in the corresponding emulsion, grain, or grain region being discussed; e.g., a grain consisting of silver bromoiodide containing 40 mole percent iodide also contains 60 mole percent bromide.) In one preferred form the emulsions of the present invention incorporate at least about 0.1 mole percent iodide. Silver ioide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. For most photographic applications it is preferred to limit maximum iodide concentrations to about 20 mole percent, with optimum iodide concentrations being up to about 15 mole percent. In radiographic elements iodide is preferably present in concentrations up to 6 mole percent.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al, cited above, has recognized that advantages in photographic speed and/or granularity can result from increasing the proportion of iodide in laterally displaced, preferably annular, regions of tabular grain silver bromoiodide emulsions as compared to central regions of the tabular grains. Solberg et al teaches iodide concentrations in the central regions of tabular grains of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. The teachings of Solberg et al are directly applicable to this invention. The tabular silver bromoiodide grains of the present invention can exhibit substantially uniform or graded iodide concentration profiles and the gradation can be controlled, as desired, to favor higher iodide concentrations internally or at or near the surfaces of the tabular silver bromoiodide grains.

Although the preparation of the thin tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that of Wilgus and Haefner is described by Daubendiek and Strong, cited above and here incorporated by reference. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron. Again, merely by terminating precipitaton sooner, thin, intermediate aspect ratio tabular grain bromoiodide emulsions can be prepared.

Thin, high and intermediate aspect ratio tabular grain silver bromide emulsions lacking iodide can be prepared by the process described above similar to the process of Wilgus and Haefner further modified to exclude iodide. Thin tabular silver bromide emulsions containing square and rectangular grains can be prepared similarly as taught by Mignot U.S. Ser. No. 320,912, cited above. In this process cubic seed grains having an edge length of less than 0.15 micron are employed. While maintaining the pAg of the seed grain emulsion in the range of from 5.0 to 8.0, the emulsion is ripened in the substantial absence of nonhalide silver ion complexing agents to produce tabular silver bromide grains having the desired average aspect ratio. Still other preparations of thin tabular grain silver bromide emulsions lacking iodide are illustrated in the examples.

To illustrate other thin tabular grain silver halide emulsions which can be prepared merely by terminating precipitation when the desired aspect ratios are achieved, attention is directed to the following:

Maskasky, titled SILVER CHLORIDE EMULSIONS OF MODIFIED CRYSTAL HABIT AND PROCESSES FOR THEIR PREPARATION, cited above and here incorporated by reference, discloses a process of preparing tabular grains of at least 50 mole percent chloride having opposed crystal faces lying in {111} crystal planes and at least one peripheral edge lying parallel to a <211> crystallographic vector in the plane of one of the major surfaces. Such tabular grain emulsions can be prepared by reacting aqueous silver and chloride-containing halide salt solutions in the presence of a crystal habit modifying amount of an aminoazaindene and a peptizer having a thioether linkage.

Wey and Wilgus, cited above and here incorporated by reference, discloses tabular grain emulsions wherein the silver halide grains contain chloride and bromide in at least annular grain regions and preferably throughout. The tabular grain regions containing silver chloride and bromide are formed by maintaining a molar ratio of chloride and bromide ions of from 1.6:1 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and Research Disclosure, Vol. 134, June 1975, Item 13452. *Research Disclosure* and its predecessor, *Product Licensing Index*, are publications of Industrial Opportunities Ltd.; Homewell, Havant; Hampshire, P09 1EF, United Kingdom. The tabular grain emulsions can be internally reduction sensitized during precipitation, as illustrated by Moisar et al, *Journal of Photographic Science*, Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz*, Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. Patent Application No. 2,022,431A, Saito et al German OLS 2,555,364 and 2,556,885, and *Research Disclosure*, Volume 166, February 1978, Item 16662.

In forming the tabular grain emulsions peptizer concentrations of from 0.2 to about 10 percent by weight, based on the total weight of emulsion components in the reaction vessel, can be employed; it is preferred to keep the concentration of the peptizer in the reaction vessel prior to and during silver bromoiodide formation below about 6 percent by weight, based on the total weight. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the silver bromoiodide emulsions of this invention exhibiting the highest realized speed-granularity relationships.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide, based on the weight of silver. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The thin tabular grain emulsions employed in the present invention are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry,* Vol. 6, No. 3, 1974, pp. 181-185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure,* Vol. 101, September 1972, Item 10152. In the present invention washing is particularly advantageous in terminating ripening of the tabular grains after the completion of precipitation to avoid increasing their thickness and reducing their aspect ratio.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be produced. Maximum average aspect ratios have been observed to vary, depending upon the precipitation technique employed and the tabular grain halide composition. The highest observed average aspect ratios, 500:1, for tabular grains with photographically useful average grain diameters, have been achieved by Ostwald ripening preparations of silver bromide grains, with aspect ratios of 100:1, 200:1, or even higher being obtainable by double-jet precipitation procedures. The presence of iodide generally decreases the maximum average aspect ratios realized, but the preparation of silver bromoiodide tabular grain emulsions having average aspect ratios of 100:1 or even 200:1 or more is feasible. Average aspect ratios as high as 50:1 or even 100:1 for silver chloride tabular grains, optionally containing bromide and/or iodide, can be prepared as taught by Maskasky, cited above. It is contemplated that in all instances the average diameter of the thin tabular grains will be less than 30 microns, preferably less than 15 microns, and optimally no greater than 10 microns.

The present invention is equally applicable to photographic elements intended to form negative or positive images. For example, the photographic elements can be of a type which form either surface or internal latent images on exposure and which produce negative images on processing. Alternatively, the photographic elements can be of a type that produce direct positive images in response to a single development step. When the tabular and other imaging silver halide grains present in the photographic element are intended to form direct positive images, they can be surface fogged and employed in combination with an organic electron acceptor, as taught, for example, by Kendall et al U.S. Pat. No. 2,541,472, Shouwenaars U.K. Pat. No. 723,019, Illingsworth U.S. Pat. Nos. 3,501,305, '306, and '307, *Research Disclosure,* Vol. 134, June 1975, Item 13452, Kurz U.S. Pat. No. 3,672,900, Judd et al U.S. Pat. No. 3,600,180, and Taber et al U.S. Pat. No. 3,647,643. The organic electron acceptor can be employed in combination with a spectrally sensitizing dye or can itself be a spectrally sensitizing dye, as illustrated by Illingsworth et al U.S. Pat. No. 3,501,310. If internally sensitive emulsions are employed, surface fogging and organic electron acceptors can be employed in combination, as illustrated by Lincoln et al U.S. Pat. No. 3,501,311, but neither surface fogging nor organic electron acceptors are required to produce direct positive images. Direct positive images can be formed by development of internally sensitive emulsions in the presence of nucleating agents, which can be contained in either the developer or the photographic element, as illustrated by *Research Disclosure,* Vol. 151, November 1976, Item 15162. Preferred nucleating agents are those adsorbed directly to the surfaces of the silver halide grains, as illustrated by Lincoln et al U.S. Pat. Nos. 3,615,615 and 3,759,901, Spence et al U.S. Pat. No. 3,718,470, Kurtz et al U.S. Pat. Nos. 3,719,494 and 3,734,738, Leone et al U.S. Pat. Nos. 4,030,925 and 4,080,207, Adachi et al U.S. Pat. No. 4,115,122, von Konig et al U.S. Pat. No. 4,139,387, and U.K. Pat. Nos. 2,011,391 and 2,012,443. Evans, Daubendiek, and Raleigh U.S. Ser. No. 431,912, titled DIRECT REVERSAL EMULSIONS AND PHOTOGRAPHIC ELEMENTS USEFUL IN IMAGE TRANSFER FILM UNITS, filed concurrently herewith and commonly assigned, which is a continuation-in-part of U.S. Ser. No. 320,891, filed Nov. 12, 1981, both here incorporated by reference, discloses internal latent image-forming high aspect ratio thin tabular grain emulsions containing nucleating agents. Similar emulsions, but containing thin tabular grains of intermediate aspect ratios, are also useful in the practice of this invention.

In addition to the specific features described above the photographic elements of this invention can employ conventional features, such as those of the paragraphs cited below in *Research Disclosure,* Item 17643, previously cited, here incorporated by reference. The emulsions can be chemically sensitized, as described in Paragraph III, and/or spectrally sensitized or desensitized, as described in Paragraph IV. Preferred chemical and spectral sensitization of thin tabular grain emulsions according to this invention is described by Kofron et al, cited above. The photographic elements can contain brighteners, antifoggants, stabilizers, scattering or absorbing materials, coating aids, plasticizers, lubricants, and matting agents, as described in *Research Disclosure,* Item 17643, cited above, Paragraphs V, VI, VIII, XI, XII, and XVI. Methods of addition and coating and drying procedures can be employed, as described in Paragraphs XIV and XV. Conventional photographic supports can be employed, as described in Paragraph XVII. Other conventional features will readily be suggested to those skilled in the art.

The invention is particularly applicable to radiographic elements. The preferred radiographic elements of this invention are those produced by fully forehardening the radiographic elements containing at least one thin, high or intermediate aspect ratio tabular grain emulsion layer disclosed by Abbott and Jones, cited above and here incorporated by reference. Abbott and Jones disclose the use of two image-forming layer units located on opposed major surfaces of the support. The interposed support is capable of transmitting radiation to which at least one and, typically, both of the image-forming layer units are responsive. That is, the support is specularly transmissive to exposing radiation. The support is substantially colorless and transparent, even though it can be tinted. The two image-forming layer units each contain at least one radiation-sensitive emulsion containing thin tabular silver halide grains having an intermediate average aspect ratio of the type more specifically described above.

To achieve both the advantages in covering power of the present invention and the crossover advantages disclosed by Abbott et al the tabular silver halide grains have adsorbed to their surfaces spectral sensitizing dye. It is specifically contemplated to employ spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The thin tabular grain silver halide emulsions can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering,* Vol. 18, 1974, pp. 49–53 (Sturmer et al), pp. 175–178 (Leubner) and pp. 475–485 (Gilman). Oxidation and reduction potentials can be measured as described by R. F. Large in *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes,* Academic Press, New York, 1971, Chapter V; James, *The Theory of the Photographic Process,* 4th Ed., Macmillan, 1977, Chapter 8, and F. M. Hamer, *Cyanine Dyes and Related Compounds,* John Wiley and Sons, 1964.

In a preferred form of this invention the tabular silver halide grains have adsorbed to their surfaces spectral sensitizing dye which exhibits a shift in hue as a function of adsorption. Any conventional spectral sensitizing dye known to exhibit a bathochromic or hypsochromic increase in light absorption as a function of adsorption to the surface of silver halide grains can be employed in the practice of this invention. Dyes satisfying such criteria are well known in the art, as illustrated by T. H. James, *The Theory of the Photographic Process,* 4th Ed., Macmillan, 1977, Chapter 8 (particularly, F. Induced Color Shifts in Cyanine and Merocyanine Dyes) and Chapter 9 (particularly, H. Relations Between Dye Structure and Surface Aggregation) and F. M. Hamer, *Cyanine Dyes and Related Compounds,* John Wiley and Sons, 1964, Chapter XVII (particularly, F. Polymerization and Sensitization of the Second Type). Merocyanine, hemicyanine, styryl, and oxonol spectral sensitizing dyes which produce H aggregates (hypsochromic shifting) are known to the art, although J aggregates (bathochromic shifting) is not common for dyes of these classes. Preferred spectral sensitizing dyes are cyanine dyes which exhibit either H or J aggregation.

In a specifically preferred form the spectral sensitizing dyes are carbocyanine dyes which exhibit J aggregation. Such dyes are characterized by two or more basic heterocyclic nuclei joined by a linkage of three methine groups. The heterocyclic nuclei preferably include fused benzene rings to enhance J aggregation. Preferred heterocyclic nuclei for promoting J aggregation are quinolinium, benzoxazolium, benzothiazolium, benzoselenazolium, benzimidazolium, naphthoxazolium, naphthothiazolium, and naphthoselenazolium quaternary salts.

Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes.

Useful blue spectral sensitizing dyes for thin tabular grain silver bromide and silver bromoiodide emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (Reissue 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and nonlight absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or thick tabular silver halide grains. To realize the full advantages of thin tabular grain emulsions it is preferred to adsorb spectral sensitizing dye to the tabular grain surfaces in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.,* Vol. 56, p. 1065, 1952; Spence et al, "Desensitization of Sensitizing Dyes", *Journal of Physical and Colloid Chemistry,* Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process,* 1942, Macmillan, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure,* Vol. 181, May 1979, Item 18155.

In one preferred form, spectral sensitizers can be incorporated in the emulsions of the present invention prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,642,361, cited above. Other ripening agents can be used during chemical sensitization.

In still a third approach, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide, iodide, and/or chloride) grains capable of Ostwald ripening onto the tabular grain surfaces can be introduced. For example, a Lippmann emulsion can be introduced during chemical sensitization. Maskasky, titled CONTROLLED SITE EPITAXIAL SENSITIZATION, cited above and here incorporated by reference, discloses the chemical sensitization of spectrally sensitized thin tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed-granularity relationships are gold and sulfur sensitizers, gold and selenium sensitizers, and gold, sulfur, and selenium sensitizers. Thus, in a preferred form of the invention, thin tabular grain silver bromide or, most preferably, silver bromoiodide emulsions contain a middle chalcogen, such as sulfur and/or selenium, which may not be detectable, and gold, which is detectable. The emulsions also usually contain detectable levels of thiocyanate, although the concentration of the thiocyanate in the final emulsions can be greatly reduced by known emulsion washing techniques. In various of the preferred forms indicated above the tabular silver bromide or silver bromoiodide grains can have another silver salt at their surface, such as silver thiocyanate or another silver halide of differing halide content (e.g., silver chloride or silver bromide), although the other silver salt may be present below detectable levels.

Although not required to realize all of their advantages, the emulsions employed in the present invention are preferably, in accordance with prevailing manufacturing practices, substantially optimally chemically and spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.1 above fog. Once the silver halide grains of an emulsion have been characterized, it is possible to estimate from further product analysis and performance evaluation whether an emulsion layer of a product appears to be substantially optimally chemically and spectrally sensitized in relation to comparable commercial offerings of other manufacturers.

In addition to the features specifically described above the radiographic elements of this invention can include additional features of a conventional nature in radiographic elements. Exemplary features of this type are disclosed, for example, in *Research Disclosure,* Vol. 184, August 1979, Item 18431. For example, the emulsions can contain stabilizers, antifoggants, and antikink agents, as set forth in Paragraph II, A through K. The radiographic element can contain antistatic agents and/or layers, as set forth in Paragraph III. The radiographic elements can contain overcoat layers, as set out in Paragraph IV. The crossover advantages of Abbott et al can be further improved by employing conventional crossover exposure control approaches, as disclosed in Item 18431, Paragraph V.

Preferred radiographic elements are of the type disclosed by Abbott and Jones, cited above. That is, at least one thin tabular grain emulsion layer is incorporated in each of two imaging units located on opposite major surfaces of a support capable of permitting substantially specular transmission of imaging radiation. Such radiographic supports are most preferably polyester film supports. Poly(ethylene terephthalate) film supports are specifically preferred. Such supports as well as their preparation are disclosed in Scarlett U.S. Pat. No. 2,823,421, Alles U.S. Pat. No. 2,779,684, and Arvidson and Stottlemyer U.S. Pat. No. 3,939,000. Medical radiographic elements are usually blue tinted. Generally the tinting dyes are added directly to the molten polyester prior to extrusion and therefore must be thermally stable. Preferred tinting dyes are anthraquinone dyes, such as those disclosed by Hunter U.S. Pat. No. 3,488,195, Hibino et at U.S. Pat. No. 3,849,139, Arai et al U.S. Pat. Nos. 3,918,976 and 3,933,502, Okuyama et al U.S. Pat. No. 3,948,664, and U.K. Pat. Nos. 1,250,983 and 1,372,668.

The preferred spectral sensitizing dyes are chosen to exhibit an absorption peak shift in their adsorbed state, usually in the H or J band, to a region of the spectrum corresponding to the wavelength of electromagnetic radiation to which the element is intended to be imagewise exposed. The electromagnetic radiation producing imagewise exposure is typically emitted from phosphors of intensifying screens. A separate intensifying screen exposes each of the two imaging units located on opposite sides of the support. The intensifying screens can emit light in the ultraviolet, blue, green, or red portions of the spectrum, depending upon the specific phosphors chosen for incorporation therein. In a specifically preferred form of the invention the spectral sensitizing dye is a carbocyanine dye exhibiting a J band absorption when adsorbed to the tabular grains in a spectral region corresponding to peak emission by the intensifying screen, usually the green region of the spectrum.

The intensifying screens can themselves form a part of the radiographic elements, but usually they are separate elements which are reused to provide exposures of successive radiographic elements. Intensifying screens are well known in the radiographic art. Conventional intensifying screens and their components are disclosed by *Research Disclosure,* Vol. 18431, cited above, Paragraph IX, and by Rosecrants U.S. Pat. No. 3,737,313, the disclosures of which are here incorporated by reference.

To obtain a viewable silver image the photographic or, in preferred applications, radiographic elements are processed in an aqueous alkaline developer or, where the developing agent is incorporated in the photographic element, in an aqueous alkaline activator solution. Development which favors the highest attainable covering power is preferred. As pointed out by James, *The Theory of the Photographic Process,* cited above, pp. 40–4,405, 489, and 490, as well as Farnell and Solman, also cited above, the highest levels of covering power result from obtaining the most filamentary developed silver. Direct or chemical development produces comparatively higher covering power than physical development and is therefore preferred. Where silver halide grains are employed that form predominantly surface latent images, it is preferred to employ developers which contain low levels of silver halide solvents—i.e., surface developers. It is recognized that covering power is increased by developing over a short time period—that is, at a comparatively high rate. The exposed photographic elements of this invention when developed in less than 1 minute and preferably less than 30 seconds to produce a viewable silver image exhibit increased covering power; however, covering power is substantially reduced and bears little relation to grain aspect ratio when development is conducted over eight minutes. To achieve rapid development, it is preferred to employ comparatively vigorous developing agents. Preferred developing agents are hydroquinones employed alone or, preferably, in combination with secondary developing agents, such as pyrazolidones, particularly 3-pyrazolidones such as disclosed by Kendall U.S. Pat. No. 2,289,367, Allen U.S. Pat. No. 2,772,282, Stewart et al U.K. Pat. No. 1,023,701, and DeMarle et al U.S. Pat. Nos. 3,221,023 and 3,241,967, and aminophenols, such as p-methylaminophenol sulfate.

Processing techniques of the type illustrated by *Research Disclosure,* Item 17643, cited above, Paragraph XIX, can be employed. Roller transport processing of radiographic elements is particularly preferred, as illustrated by Russell et al U.S. Pat. Nos. 3,025,779 and 3,515,556, Masseth U.S. Pat. No. 3,573,914, Taber et al U.S. Pat. No. 3,647,459, and Rees et al U.K. Pat. No. 1,269,268. While the photographic elements of this invention are forehardened, they can be used with conventional developers containing prehardeners without any loss in covering power. Since the elements are normally fully forehardened, it is, of course, preferred to entirely eliminate hardeners from the processing solutions. Following development the photographic elements can be fixed to remove residual silver halide by any convenient conventional technique.

EXAMPLES

The invention can be better appreciated by reference to the following illustrative examples. In each of the examples the contents of the reacton vessel were stirred vigorously throughout silver and halide salt introductions; the term "percent" means percent by weight, unless otherwise indicated; and the term "M" stands for molar concentration, unless otherwise indicated. All solutions, unless otherwise indicated, are aqueous solutions.

EXAMPLES 1 THROUGH 15

For the purpose of comparing covering power as a function of tabular grain aspect ratio, three tabular silver bromide emulsions according to the present invention and a tabular silver bromoiodide prepared according to the teachings of Maternaghan U.S. Pat. No. 4,150,994 having a lower aspect ratio were prepared. The tabular grain characteristics of the emulsions are set forth below in Table I.

TABLE I

| Emulsion | Average Aspect Ratio | Diameter (μm) | Thickness (μm) | Percent of Projected Area |
|---|---|---|---|---|
| Control Emulsion | 3.3:1 | 1.4 | 0.42 | |
| Example Emulsion A | 12:1 | 2.7 | 0.22 | >80 |
| Example Emulsion B | 14:1 | 2.3 | 0.16 | >90 |
| Example Emulsion C | 25:1 | 2.5 | 0.10 | >90 |

Example emulsions A, B, and C were high aspect ratio tabular grain emulsions within the definition limits of this patent application. Although some tabular grains of less than 0.6 micron in diameter were included in computing the tabular grain average diameters and percent projected area in these and other example emulsions, except where their exclusion is specifically noted, insufficient small diameter grains were present to alter significantly the numbers reported. To obtain a representative average aspect ratio for the grains of the control emulsion the average grain diameter was compared to the average grain thickness. Although not measured, the projected area that could be attributed to the few tabular grains meeting the less than 0.3 micron thickness and at least 0.6 micron diameter criteria in the control emulsion was estimated by visual inspection to account for very little, if any, of the total projected area of the total grain population of the control emulsion.

The emulsions were each chemically sensitized with sulfur and gold and sensitized to the green portion of the spectrum with 600 mg/Ag mole of anhydro-5,5'-dichloro-9-ethyl-3,3'-di(3-sulfopropyl)-oxacarbocyanine, sodium salt and 400 mg/Ag mole of potassium iodide.

The emulsions were then divided into separate samples for hardening. Three samples of each emulsion received 0.5, 1.5, and 4.5 percent by weight, based on the weight of gelatin, respectively, of the hardener bis(vinylsulfonylmethyl) ether (BVSME). Three samples of each emulsion received 0.24, 0.75, and 2.5 percent by weight, based on the weight of gelatin, respectively, of the hardener formaldehyde (HCHO). Three samples of each emulsion received 0.24, 0.75, and 2.5 percent by weight, based on the weight of gelatin, respectively, of the hardener mucochloric acid (MA). Immediately after receipt of the hardener each sample was identically coated on separate, identical poly(ethylene terephthalate) transparent film supports. The emulsion samples were each coated at 2.15 g silver per $m^2$ and 2.87 g gelatin per $m^2$. Each sample was overcoated with 0.88 g gelatin per $m^2$.

The unprocessed coated samples were measured for percent swell 7 days after coating, which included 3 days incubation at 38° C. at 50 percent relative humidity. Emulsion layer thickness was initially measured, and each sample was then immersed in distilled water at 21° C. for 3 minutes. The change in the emulsion layer thickness was then measured.

Only a portion of each sample was required to perform the swell measurement procedure described above. A remaining portion of each sample was exposed to obtain a maximum density and processed in a conventional radiographic element processor, commercially available under the trademark Kodak RP X-Omat Film Processor M6A-N. Development time was 21 seconds at 35° C. Instead of using the standard developer for this processor, which contains glutaraldehyde as a prehardener, a similar developer of the type disclosed by Example 1 of Barnes et al U.S. Pat. No. 3,545,971 was employed, but the glutaraldehyde prehardener was omitted, and the developer contained no hardener.

By plotting covering power versus percent swell using three samples hardened to differing degrees with the same hardener, the covering power of each emulsion with each hardener at 199 percent swell (except as indicated) was determined. The results are set forth below in Table II.

TABLE II

| Sample | Average Aspect Ratio | Hardener | Covering Power |
|---|---|---|---|
| Control-1 | 3:1 | BVSME | 60 |
| Control-2 | 3:1 | MA | 69 (at 150% swell) |
| Control-3 | 3:1 | HCHO | 68 (at 115% swell) |
| Example-1 | 12:1 | BVSME | 79 |
| Example-2 | 12:1 | MA | 78 |
| Example-3 | 12:1 | HCHO | 75 |
| Example-4 | 14:1 | BVSME | 98 |
| Example-5 | 14:1 | MA | 97 |
| Example-6 | 14:1 | HCHO | 94 |
| Example-7 | 25:1 | BVSME | 115 |
| Example-8 | 25:1 | MA | 122 |
| Example-9 | 25:1 | HCHO | 114 |

From Table II it is apparent that at the same level of hardening the photographic elements prepared with the emulsions of the present invention exhibited higher covering power and that the covering power increase was produced by the higher aspect ratios of the tabular silver bromide emulsions.

The results in Table III are similar to those reported in Table II, but with the difference that the covering power was measured at 99 percent swell (except as otherwise indicated).

TABLE III

| Sample | Average Aspect Ratio | Hardener | Covering Power |
|---|---|---|---|
| Control-1 | 3:1 | BVSME | 48 |
| Control-2 | 3:1 | MA | 69 (at 150% swell) |
| Control-3 | 3:1 | HCHO | 68 (at 115% swell) |
| Example-10 | 12:1 | BVSME | 80 |
| Example-11 | 12:1 | HCHO | 76 |
| Example-12 | 14:1 | BVSME | 95 |
| Example-13 | 14:1 | HCHO | 92 |
| Example-14 | 25:1 | BVSME | 110 |
| Example-15 | 25:1 | HCHO | 115 |

Because mucochloric acid is a weaker hardener, the concentrations employed were insufficient to reduce percent swell below 100 percent, and accordingly covering power at that swell level cannot be reported. It is believed that the swell could have been reduced below 100 percent with mucochloric acid, if higher concentrations had been employed.

Appendix

The following preparative details form no part of this invention:

A. Example Emulsion A

To a 17.5 liter aqueous bone gelatin, 0.14 molar potassium bromide solution (1.5% gelatin, Solution A) at 55° C. and pBr 0.85 were added by double-jet addition over an 8 minute period (consuming 1.05% of the total silver used) an aqueous solution of potassium bromide (1.15 molar, Solution B-1) and an aqueous solution of silver nitrate (1.00 molar, Solution C-1). After the initial 8 minutes, Solutions B-1 and C-1 were halted.

Aqueous solutions of potassium bromide (2.29 molar, Solution B-2) and silver nitrate (2.0 molar, Solution C-2) were added next to the reaction vessel by the double-jet technique at pBr 0.85 and 55° C. using an accelerated flow rate (4.2X from start to finish) until Solution C-2 was exhausted (approximately 20 minutes; consuming 14.1% of the total silver used). Solution B-2 was halted.

An aqueous solution of silver nitrate (2.0 molar, Solution C-3) was added to the reaction vessel for approximately 12.3 minutes until pBr 2.39 at 55° C. was attained, consuming 10.4% of the total silver used. The emulsion was held at pBr 2.39 at 55° C. with stirring for 15 minutes.

Solution C-3 and an aqueous solution of potassium bromide (2.0 molar, Solution B-3) were added next by double-jet addition to the reaction vessel at a constant flow rate over approximately an 88 minute period (consuming 74.5% of the total silver used) while maintaining pBr 2.39 at 55° C. Solutions B-3 and C-3 were halted. A total of 41.1 moles of silver were used to prepare this emulsion.

Finally the emulsion was cooled to 35° C. and coagulation washed as described in Yutzy and Russell U.S. Pat. No. 2,614,929.

B. Example Emulsion B

To an aqueous 0.14 molar potassium bromide solution of bone gelatin (1.5% gelatin, Solution A) at pBr 0.85 and 55° C. were added with stirring by double-jet addition at constant flow rate over an 8 minute period (consuming 3.22% of the total silver used) an aqueous solution of potassium bromide (1.15 molar, Solution B-1) and silver nitrate (1.0 molar, Solution C-1). After the initial 8 minute period Solutions B-1 and C-1 were halted.

Aqueous solutions of potassium bromide (3.95 molar, Solution B-2) and silver nitrate (2.0 molar, Solution C-2) were added next at pBr 0.85 and 55° C. utilizing an accelerated double-jet flow rate (4.2X from start to finish) until Solution C-2 was exhausted (approximately 20 minutes; consuming 28.2% of the total silver used). Solution B-2 was halted.

An aqueous solution of silver nitrate (2.0 molar, Solution C-3) was added at constant flow rate for approximately 2.5 minutes until pBr 2.43 at 55° C. was attained, consuming 4.18% of the total silver used. The emulsion was held with stirring for 15 minutes at 55° C.

Solution C-3 and an aqueous solution of potassium bromide (2.0 molar, Solution B-3) were added next at pBr 2.43 and 55° C. utilizing an accelerated flow rate technique (1.4X from start to finish) for 31.1 minutes (consuming 64.4% of the total silver used). Solutions B-3 and C-3 were halted. 29.5 Moles of silver were used to prepare the emulsion.

Finally, the emulsion was cooled to 35° C. and coagulation washed as described for Example 1.

C. Example Emulsion C

To an aqueous bone gelatin, 0.14 molar potassium bromide solution (1.5% gelatin, Solution A) at pBr 0.85 and 55° C. were added by double-jet addition with stirring at constant flow rate over an 8 minute period (consuming 4.76% of the total silver used) an aqueous solution of potassium bromide (1.15 molar, Solution B-1) and an aqueous solution of silver nitrate (1.0 molar, Solution C-1). After the initial 8 minutes, Solutions B-1 and C-1 were halted.

Aqueous solutions of potassium bromide (2.29 molar, Solution B-2) and silver nitrate (2.0 molar, Solution C-2) were added next at pBr 0.85 and 55° C. by double-jet addition utilizing accelerated flow (4.2X from start to finish) until Solution C-2 was exhausted (approximately 20 minutes; consuming 59.5% of the total silver used). Solution B-2 was halted. Halide salts Solutions B-1 and B-2 were each added at three points to the surface of Solution A in the procedure described above.

An aqueous solution of silver nitrate (2.0 molar, Solution C-3) was added for approximately 10 minutes at a constant flow rate to the reaction vessel until pBr 2.85 at 55° C. was attained, consuming 35.7% of the total silver used. A total of 23.5 moles of silver were used to prepare this emulsion.

Finally, the emulsion was cooled to 35° C. and coagulation washed as described for Example 1.

D. Control Emulsion—This emulsion was precipitated as described in Maternaghan U.S. Pat. No. 4,184,877.

To a 5 percent solution of gelatin in 17.5 liters of water at 65° C. were added with stirring and by double-jet 4.7 M ammonium iodide and 4.7 M silver nitrate solutions at a constant equal flow rate over a 3 minute period while maintaining a pI of 2.1 (consuming approximately 22 percent of the silver used in the seed grain preparation). The flow of both solutions was then adjusted to a rate consuming approximately 78 percent of the total silver used in the seed grain preparation over a period of 15 minutes. The run of the ammonium iodide solution was then stopped, and the addition of the silver nitrate solution continued to a pI of 5.0. A total of approximately 56 moles of silver was used in the preparation of the seed grains. The emulsion was cooled to 30° C. and used as a seed grain for further precipitation as described hereinafter.

A 15.0 liter 5 percent gelatin solution containing 4.1 moles of the 0.24 μm AgI emulsion (as prepared above) was heated to 65° C. A 4.7 M ammonium bromide solution and a 4.7 M silver nitrate solution were added by double-jet at an equal constant flow rate over a period of 7.1 minutes while maintaining a pBr of 4.7 (consuming 40.2 percent of the total silver used in the precipitation on the seed grains). Addition of the ammonium bromide solution alone was then continued until a pBr of approximately 0.9 was attained at which time it was stopped. A 2.7 liter solution of 11.7 M ammonium hydroxide was then added, and the emulsion was held for 10 minutes. The pH was adjusted to 5.0 with sulfuric acid, and the double-jet introduction of the ammonium bromide and silver nitrate solution was resumed for 14 minutes maintaining a pBr of approximately 0.9 and at a rate consuming 56.8% of the total silver consumed. The pBr was then adjusted to 3.3 and the emulsion cooled to 30° C. A total of approximately 87 moles of silver was used. The emulsion was coagulation washed as described in Example 1.

E. Example Emulsions A, B, and C prepared as described above were each optimally chemically sensitized with 5 mg/Ag mole of potassium tetrachloroaurate, 150 mg/Ag mole of sodium thiocyanate, and 10 mg/Ag mole of sodium thiosulfate at 70° C. The Control Emusion was optimally chemically sensitized according to the teaching of Maternaghan with 0.6 mg/Ag mole of potassium tetrachloroaurate and 4.2 mg/Ag mole of sodium thiosulfate at 70° C.

The invention has been described in detail with particular reference to preferred embodiments thereof, but it will be understood that variations and modifications can be effected within the spirit and scope of the invention.

What is claimed is:

1. In a radiographic element comprised of
a support and, located on the support,
one or more hydrophilic colloid layers including at least one emulsion layer containing radiation-sensitive silver halide grains,
the improvement wherein
at least 50 percent of the total projected area of said silver halide grains in at least said one emulsion layer is provided by thin tabular grains having an average aspect ratio of greater than 8:1 and a thickness of 0.2 micron or less and
said hydrophilic colloid layers are forehardened in an amount sufficient to reduce swelling of said layers to less than 200 percent, percent swelling being determined by (a) incubating said photographic element at 38° C. for 3 days at 50 percent relative humidity, (b) measuring layer thickness, (c) immersing said photographic element in distilled water at 21° C. for 3 minutes, and (d) determining the precent change in layer thickness as compared to the layer thickness measured in step (b).

2. An improved radiographic element according to claim 1 wherein said silver halide grains have an average diameter of at least 0.6 micron.

3. An improved radiographic element according to claim 2 wherein said silver halide grains have an average diameter of at least 1.0 micron.

4. An improved radiographic element according to claim 1 wherein said silver halide is a silver bromide or silver bromoiodide.

5. An improved radiographic element according to claim 1 wherein said hydrophilic colloid layers contain gelatin or a hardenable gelatin derivative.

6. An improved radiographic element according to claim 1 wherein said hydrophilic colloid layers are forehardened with an aldehyde type hardener.

7. An improved radiographic element according to claim 1 wherein said hydrophilic colloid layers are forehardened with an active olefin type hardener containing two or more active olefin bonding sites.

8. An improved radiographic element according to claim 1 wherein said hydrophilic colloid layers are forehardened with a halogen-substituted aldehyde acid type hardener.

9. An improved radiographic element according to claim 1 wherein said hydrophilic colloid layers are forehardened in an amount sufficient to reduce swelling of said layers to less than 100 percent.

10. An improved radiographic element according to claim 1 wherein said photographic element exhibits a covering power of at least 80 when developed in less than 1 minute.

11. An improved radiographic element according to claim 1 wherein said tabular silver halide grains account for at least 70 percent of the total projected area of said silver halide grains.

12. In a radiographic element comprised of a substantially specularly transmissive support having first and second major surfaces and, located on each of said major surfaces, one or more hydrophilic colloid layers including at least one emulsion layer containing radiation-sensitive silver bromide grains containing up to 6 mole percent iodide, the improvement wherein at least 50 percent of the total projected area of said silver bromide grains in at least one emulsion layer is provided by thin tabular silver bromide grains optionally containing iodide having a thickness of less than 0.2 micron and an average aspect ratio in the range of at least 12:1 and said hydrophilic colloid layers being forehardened in an amount sufficient to reduce swelling of said layers to less than 200 percent, percent swelling being determined by (a) incubating said photographic element at 38° C. for 3 days at 50 percent relative humidity, (b) measuring layer thickness, (c) immersing said photographic element in distilled water at 21° C. for 3 minutes, and (d) determining the percent change in layer thickness as compared to the layer thickness measured in step (b).

13. An improved radiographic element according to claim 12 wherein said silver halide grains have an average diameter of at least 0.6 micron.

14. An improved radiographic element according to claim 13 wherein said tabular silver halide grains have an average diameter of at least 1.0 micron.

15. An improved radiographic element according to claim 12 wherein said hydrophilic colloid layers consist essentially of a gelatin or a hardenable gelatin derivative vehicle.

16. An improved radiographic element according to claim 15 wherein said hydrophilic colloid layers are forehardened with a hardener chosen from the group consisting of an aldehyde type hardener, a hardener having two or more vinylsulfonyl or vinylsulfonyl precursor groups, and a mucochloric acid hardener.

17. An improved radiographic element according to claim 12 wherein said thin tabular grains have an average aspect ratio of at least 25:1 and a thickness of 0.10 micron or less.

18. An improved radiographic element according to claim 12 wherein said hydrophilic colloid layers forehardened in an amount sufficient to reduce swell of said layers to less than 100 percent.

19. An improved radiographic element according to claim 18 wherein said radiographic element exhibits a covering power of at least 100.

20. A process of producing a high covering power silver image comprising imagewise exposing a radiographic element according to any one of claims 1 through 11 and developing a viewable silver image in less than 1 minute.

21. A process according to claim 20 wherein a hydroquinone developing agent is employed.

22. A process of producing a high covering power silver image comprising imagewise exposing a radiographic element according to any one of claims 12 through 19 and developing a viewable silver image in less than 1 minute.

23. A process according to claim 22 wherein a hydroquinone developing agent is employed.

24. A process according to claim 22 wherein processing is undertaken at a temperature in the range of from 25° to 50° C.

* * * * *